US006457340B1

(12) United States Patent
Kanemitsu et al.

(10) Patent No.: US 6,457,340 B1
(45) Date of Patent: Oct. 1, 2002

(54) METHOD OF FORMING A BOSS OF A BOSS-INTEGRATED SHEET METAL MEMBER

(75) Inventors: Toshiaki Kanemitsu, Kobe; Kunihiro Harada, Miki; Naoki Fujii, Kobe, all of (JP)

(73) Assignee: Kabushiki Kaisha Kanemitsu, Hyogo (JP)

( * ) Notice: Subject to any disclaimer, the term of this patent is extended or adjusted under 35 U.S.C. 154(b) by 0 days.

(21) Appl. No.: 09/051,797

(22) PCT Filed: Oct. 7, 1996

(86) PCT No.: PCT/JP96/02922

§ 371 (c)(1),
(2), (4) Date: Apr. 23, 1998

(87) PCT Pub. No.: WO98/15369

PCT Pub. Date: Apr. 16, 1998

(51) Int. Cl.[7] ..... B21D 22/06
(52) U.S. Cl. ..... 72/335
(58) Field of Search ..... 72/327, 328, 333, 72/335, 356, 358

(56) References Cited

U.S. PATENT DOCUMENTS 5,237,849 A * 8/1993 Miyazawa ..... 72/335

FOREIGN PATENT DOCUMENTS

| | | | |
|---|---|---|---|
| JP | 58-163531 | 9/1983 | |
| JP | 59-47034 | 3/1984 | |
| JP | 63-260631 | 10/1988 | |
| JP | 1-180728 | * 7/1989 | ..... 72/335 |
| JP | 8-29375 | 3/1996 | |
| WO | WO 93/13891 | 7/1993 | |

* cited by examiner

*Primary Examiner*—Lowell A. Larson
(74) *Attorney, Agent, or Firm*—Jones, Tullar & Cooper, P.C.

(57) ABSTRACT

In a sheet metal member having a boss which is obtained by the method of the present invention, a cylindrical portion is formed at an outer peripheral edge, thereby allowing the member to be used as a pulley for a flat belt, a V belt or a poly-V belt. According to the present invention, when the boss is to be formed, the positional accuracies of portions other than the boss with respect to the boss are improved. The present invention includes: a boring step of opening a circular hole in a circular blank; a curving step of shaping the circular blank into a projected shape; and a bending step of restricting a radially outward spread of an outer peripheral edge portion of the circular blank which has undergone the curving step, and bending an inclined portion between the outer peripheral edge portion of the circular blank and the circular hole into a recessed shape, thereby forming the case-like boss. After the boring step and the curving step are conducted in an arbitrary order or the boring and curving steps are simultaneously conducted, the bending step is conducted while the circular hole is positioned to a reference position by a projection of a mold.

17 Claims, 5 Drawing Sheets

METHOD OF FORMING A BOSS OF A BOSS-INTEGRATED SHEET METAL MEMBER

TECHNICAL FIELD

The present invention relates to a method of forming a boss of a boss-integrated sheet metal member. The boss-integrated sheet metal member according to the present invention is outwardly fittingly fixed to a rotary shaft, a stationary shaft, or the like. Among the boss-integrated sheet metal members of the present invention, a member in which a cylindrical portion is formed at an outer peripheral edge may be used as a pulley for a flat belt, and that in which a V groove or poly-V grooves are formed on a cylindrical portion at an outer peripheral edge may be used as a pulley for a V belt or poly-V belts.

BACKGROUND ART

As a method of forming a boss of a boss-integrated sheet metal member, conventionally, known are a cold forging method, a drawing method, a burring method, and the like.

Among the conventional methods, the cold forging method forms a boss by using a plastic flow of the material itself. In the method, when a boss in which the projection degree (projection height) is larger as compared with the inner diameter, such as when a crank shaft pulley is to be formed by using a material of a large thickness, it is difficult to form a boss having a predetermined projection height, even though a large-size press machine of the 2,000 to 2,500 tons class is used.

In the drawing method, a material flow due to the drawing occurs, and hence the thickness of the boss tends to be insufficient, with the result that a satisfactory strength may not be obtained.

In the burring method, an edge portion of a circular hole which was previously formed by punching using a punch or the like is raised. When a boss having a small inner diameter is formed, therefore, there arises a case in which the height of the boss is not sufficiently ensured. Accordingly, the range in which a boss can be formed is largely limited by the relationship between the inner diameter and the height.

SUMMARY OF THE INVENTION

It is an object of the present invention to provide a method of forming a boss of a boss-integrated sheet metal member which can form a boss having a desired inner diameter, a desired thickness, a desired height, and a satisfactory strength, and to a boss of a boss-integrated sheet metal member by using a small press machine, and which can accurately form a boss at a center position.

The method of forming a boss of a boss-integrated sheet metal member of the present invention is a method comprising: a boring step of opening a circular hole at a center portion of a circular sheet metal blank; a curving step of shaping the circular blank into a shape which is projected toward a projection side of a boss; and a bending step of restricting a radially outward spread of an outer peripheral edge portion of the circular blank which has undergone the curving step, and pressing an inclined portion between the outer peripheral edge portion of the circular blank and the circular hole in a direction opposite to the projection direction, thereby bending the inclined portion into a recessed shape to form a case-like boss in which the circular hole serves as a tip end opening, wherein the boring step and the curving step are sequentially conducted in an arbitrary order, and the bending step is then conducted while the circular hole is positioned to a reference position.

In the method, whereby boring and the curving step are sequentially conducted in an arbitrary order, includes both cases where the boring step is conducted and the curving step is then conducted, and where the curving step is conducted and the boring step is then conducted.

The method of forming a boss of a boss-integrated sheet metal member of a variant of the present invention is a method comprising: a boring step of opening a circular hole at a center portion of a circular sheet metal blank; a curving step of shaping the circular blank into a shape which is projected toward a projection side of a boss; and a bending step of restricting a radially outward spread of an outer peripheral edge portion of the circular blank which has undergone the curving step, and pressing an inclined portion between the outer peripheral edge portion of the circular blank and the circular hole in a direction opposite to the projection direction, thereby bending the inclined portion into a recessed shape to form a case-like boss in which the circular hole serves as a tip end opening, wherein the boring step and the curving step are conducted in the same molds.

In the above-mentioned variants of the invention, each of the curving step and the bending step corresponds to a step of conducting a kind of a bending process. Therefore, the reduction of the thickness of the circular sheet metal blank due to a plastic flow of material in the curving step or the bending step, and the reduction in strength due to the thickness reduction are suppressed. Even when the circular blank has a large thickness, a boss can be formed by using a relatively small press machine. In the bending step, moreover, a radially outward spread of an outer peripheral edge portion of the circular blank which has undergone the curving step is restricted, and hence the material is prevented from flowing radially outwardly. This also serves to prevent the thickness of the boss from being reduced. In the bending step, an inclined portion between the outer peripheral edge portion of the circular blank which has undergone the curving step and the circular hole is pressed in the direction opposite to the projection direction, thereby bending the inclined portion into a recessed shape. Therefore, the height of the boss can be freely determined depending on the position of the inclined portion where the pressurization is applied. Specifically, when a part which is close to the center of the inclined portion is pressed, a boss of a small height is formed, and, when a part which is remote from the center of the inclined portion is pressed, a boss of a large height is formed.

According to the first variant of the present invention, particularly, the boring step and the curving step are sequentially conducted in an arbitrary order, and the bending step is then conducted while the circular hole opened in the boring step is positioned to a reference position. Therefore, the boss is prevented from deviating from the center in the bending step, and the boss can be accurately formed at a center position.

According to the other variant of the present invention, the boring step and the curving step are conducted in the same molds. Therefore, the circular hole can be accurately formed at a center position of the curved circular blank. In the formation of a boss, this improvement of the accuracy of the center position of the circular hole enables the boss to be accurately formed at. the center position.

In the method of forming a boss of a boss-integrated sheet metal member of a further variant of the present invention, in each of the above-mentioned methods, the bending step is conducted while the circular hole of the circular blank which has undergone the boring step and the curving step is fitted onto a projection formed on a mold for conducting the bending step, thereby positioning the circular hole to a reference position.

According to the method, when the circular hole of the circular blank is to be positioned to the reference position, it is required only to fit the circular hole onto the projection of the mold which is used for conducting the bending step. Therefore, the operation of positioning the circular hole can be conducted easily and surely, the boss is surely prevented from being deviated from the center in the bending step, and the boss can be accurately formed at the center position.

In the method of forming a boss of a boss-integrated sheet metal member of a still further variant of the present invention, in each of the above-mentioned methods, the bending step is conducted by plural stages.

According to the method, the inclined portion of the circular blank which has undergone the curving step can be bent without producing undue stress.

The method of forming a boss of a boss-integrated sheet metal member of a still further variant of the present invention relates to a method in which the boring step and the curving step are sequentially conducted in an arbitrary order, and in which, after the boring step is conducted, the curving step is conducted while the circular hole opened in the circular blank in the boring step is fitted onto a projection formed on a mold for conducting the curving step, thereby positioning the circular hole to a reference position.

According to the method also, when the circular hole of the circular blank is to be positioned to the reference position, it is required only to fit the circular hole onto the projection of the mold which is used for conducting the curving step. Therefore, the operation of positioning the circular hole can be conducted easily and surely. The curving step is conducted while positioning the circular hole opened in the boring step, to the reference position. Consequently, the center position of the boss is surely prevented from being deviated in the curving step.

DESCRIPTION OF THE PREFERRED EMBODIMENTS

Figure 1:
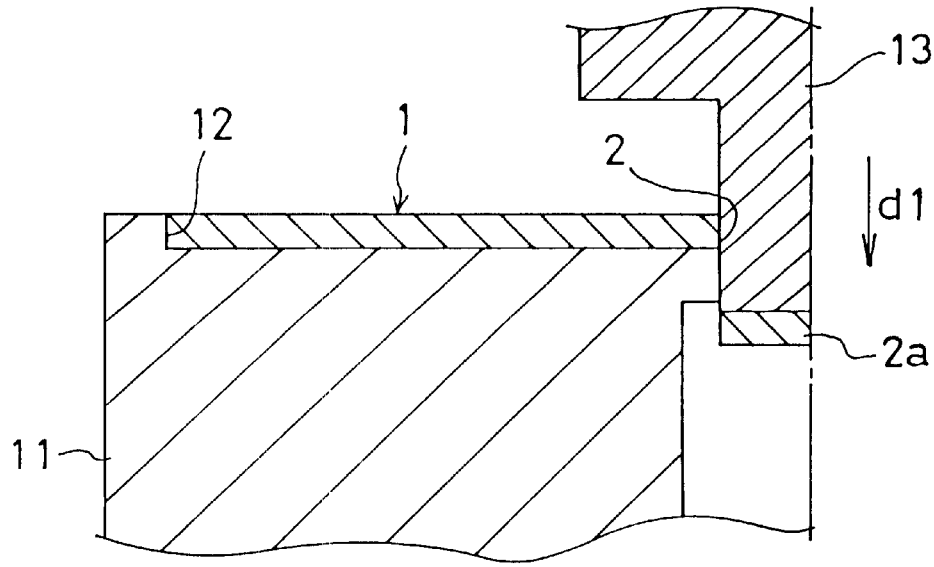
FIG. 1 is a partial section view of an apparatus showing a boring step.
Figure 2:
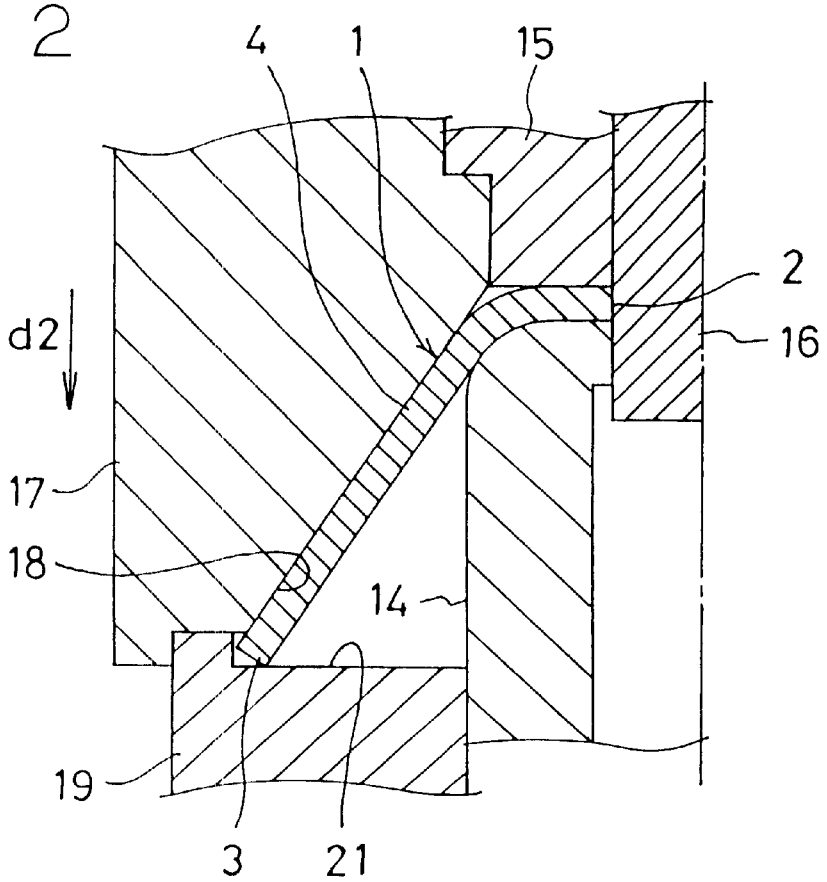
FIG. 2 is a partial section view of an apparatus showing a curving step.
Figure 3:
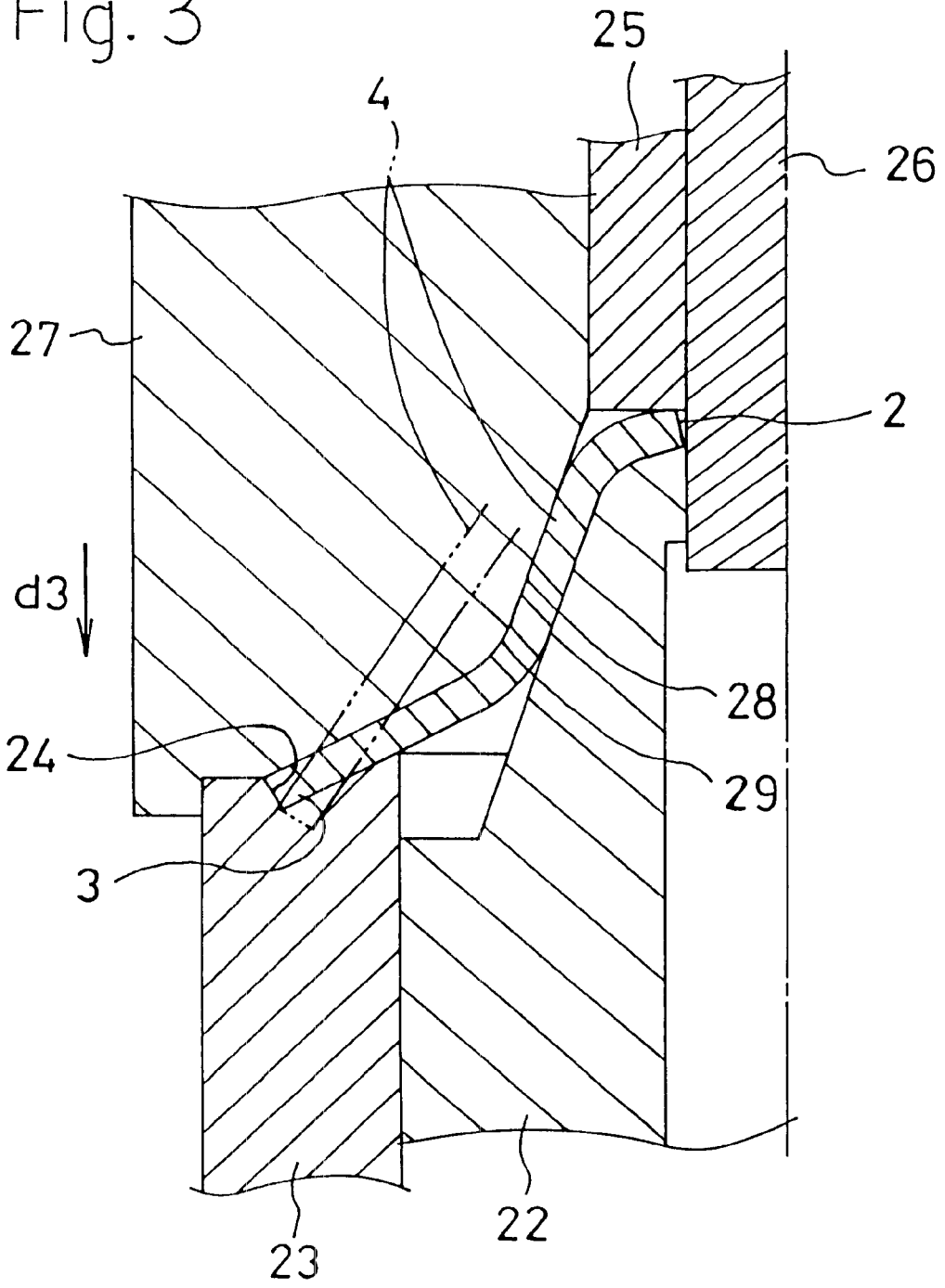
FIG. 3 is a partial section view of an apparatus showing a first stage of a bending step.
Figure 4:
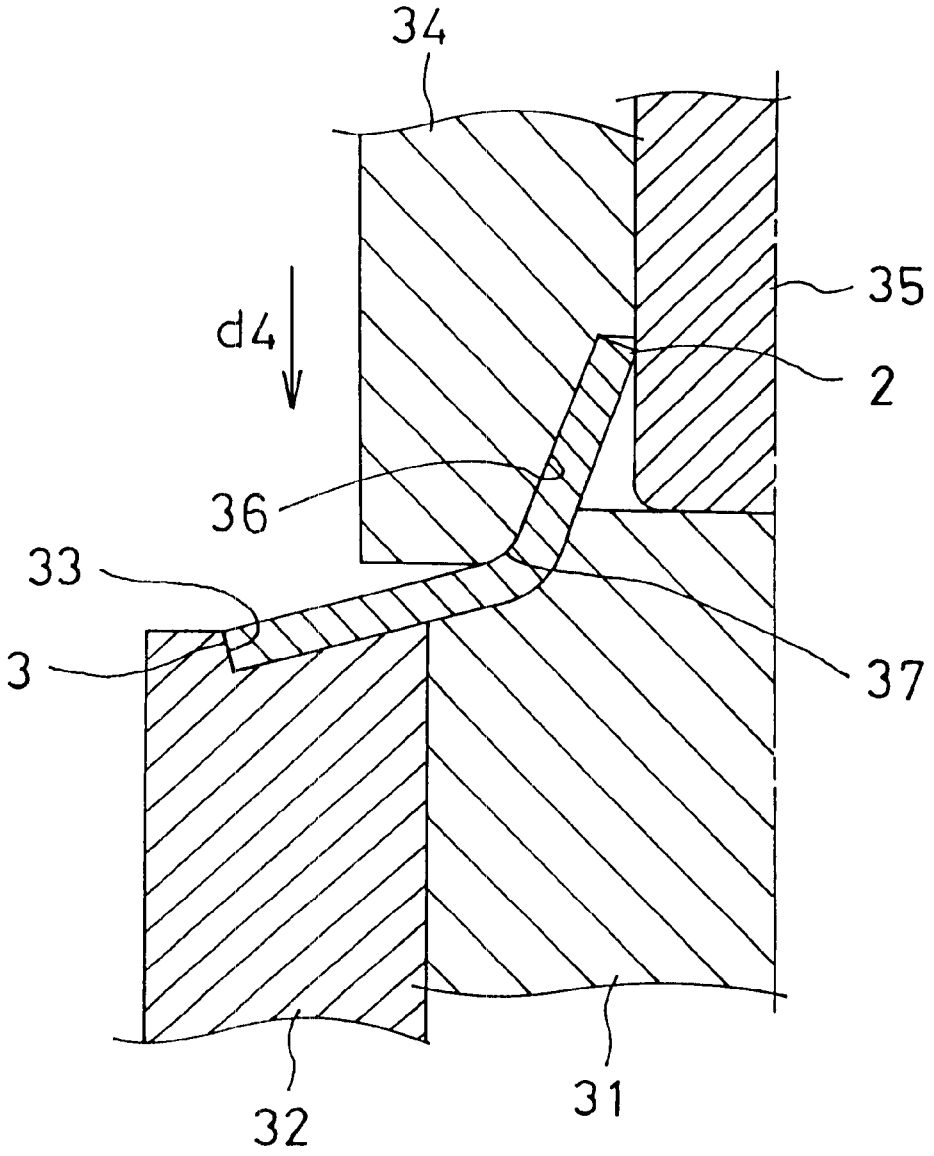
FIG. 4 is a partial section view of an apparatus showing a second stage of the bending step.
Figure 5:
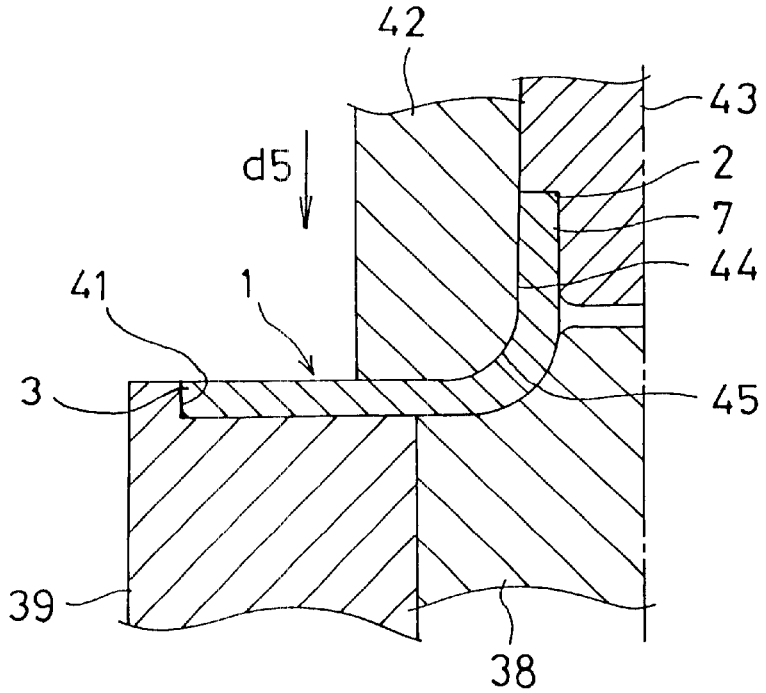
FIG. 5 is a partial section view of an apparatus showing a third stage of the bending step.

FIG. 1 is an apparatus showing a boring step, FIG. 2 is an apparatus showing a curving step, and FIGS. 3 to 5 are apparatuses showing a bending step.

In the boring step of FIG. 1, a circular blank 1 which is made of a sheet metal is set in a recess 12 formed in a lower mold 11, and a center portion of the circular blank 1 is attached to a press machine (not shown) and then punched by a punch 13 of the machine which is lowered from above as indicated by the arrow d1, forming a circular shape, and thereby a circular hole 2 at a center portion of the circular blank 1. The diameter of the circular hole 2 is slightly smaller than a boss hole of a boss (described later) which is to be formed. In FIG. 1, 2*a* designates a punched piece of the sheet metal.

The curving step of FIG. 2 is conducted on the circular blank 1 which has undergone the boring step of FIG. 1. In the curving step, the center portion of the circular blank 1 is pressingly held between a lower mold 14 and a press mold 15, and a shaft (for example, a punch disposed on the press mold 15 may be used as the shaft) 16, which can be reciprocated with respect to the press mold 15, and projects downwardly from the press mold 15, thereby fitting the circular hole 2 of the circular blank 1 onto the shaft 16. According to this configuration, the curving step is conducted using the circular hole 2 which is positioned by the shaft 16, as a reference position. The curving step is a step of shaping the circular blank 1 into a shape which is projected toward a projection side (the upper side in FIG. 2) of the boss (described later). In the example of FIG. 2, the curving step is conducted in the following manner. While at least an outer peripheral edge portion 3 of the circular blank 1 remains to be supported by a recessed receiving face 21 of a reception mold 19 disposed in the periphery of the lower mold 14, an impress mold 17 disposed in the periphery of the press mold 15 is lowered by the press machine as indicated by the arrow d2, and the circular blank 1 is pressed downwardly by a tapered press face 18 which flares downwardly, and the reception mold 19 is lowered together with the outer peripheral portion 3 of the circular blank 1, thereby bending a predetermined part of the periphery of the circular hole 2 of the circular blank 1. The shape of the circular blank 1 which is formed by conducting the curving step depends on the shapes of the lower mold 14 and the press face 18 of the impress mold 17.

As described with reference to FIG. 2, when the circular hole 2 of the circular blank 1 is positioned in the reference position in the curving step, an inclined portion 4 and the outer peripheral edge portion 3 which are formed on the circular blank 1 are correctly formed at concentric positions with respect to the circular hole 2.

The three stage bending step shown in FIGS. 3 to 5 is conducted on the circular blank 1 which has undergone the curving step. The bending step is a step of pressing the inclined portion 4 between the outer peripheral edge portion 3 of the circular blank 1 and the circular hole 2 in a direction opposite to the projection direction, thereby bending the inclined portion into a recessed shape to form a case-like boss 7 in which the circular hole 2 serves as a tip end opening. The bending step is conducted under a state where the radially outward spread of the outer peripheral edge portion 3 of the circular blank 1 is restricted.

FIG. 3 shows a first stage of the bending step. The circular blank 1 which has the inclined portion 4 as a result of the curving step is held by an apertured holder 22, and the outer peripheral edge portion 3 of the circular blank 1 abuts against a recessed receiving face 24 of a reception mold 23 disposed in the periphery of the apertured holder 22. The center portion of the circular blank 1 is pressingly held between the apertured holder 22 and a press mold 25, and a shaft (for example, a punch disposed on the press mold 25 may be used as the shaft) 26 which can be reciprocated with respect to the press mold 25 and which rejects downwardly from the press mold 25, thereby fitting the circular hole 2 of the circular blank 1 onto the shaft 26. According to this configuration, the bending step is conducted with using the circular hole 2 which is positioned by the shaft 26, as a reference position. In the first stage of the bending step, an impress mold 27 disposed in the periphery of the press mold 25 is lowered by the press machine as indicated by the arrow d3, and a shoulder portion 29 which is formed in an overhanging manner on a shaping face 28 formed on the impress mold 27 is pressed against a predetermined part of the inclined portion 4 of the circular blank 1. As a result, the inclined portion 4 is bent. At this time, the bent shape of the inclined portion 4 depends on the shapes of the reception mold 23 and the shaping face 28 of the impress mold 27.

FIG. 4 shows a second stage of the bending step. The circular blank 1 in which the inclined portion 4 is slightly bent as a result of the first stage described above, is held on a lower mold 31, and the outer peripheral edge portion 3 of the circular blank 1 abuts against a recessed receiving face 33 of a reception mold 32 disposed in the periphery of the lower mold 31. The center portion of the circular blank 1 is pressingly held between the lower mold 31 and a press mold 34, and a shaft (for example, a punch disposed on the press mold 34 may be used as the shaft) 35 which can be reciprocated with respect to the press mold 34 and which projects downwardly from the press mold 34, thereby fitting the circular hole 2 of the circular blank 1 onto the shaft 35. According to this configuration, the bending step is conducted with using the circular hole 2 which is positioned by the shaft 35, as a reference position. In the second stage of the bending step, the press mold 34 is lowered by the press machine as indicated by the arrow d4, and a lower end portion 37 of a shaping face 36 which is formed on the press mold 34 is pressed against the part of the inclined portion 4 (indicated by a phantom line in FIG. 3) which is bent in the first stage. As a result, the inclined portion 4 is further bent. At this time, the bent shape of the inclined portion 4 depends on the shapes of the lower mold 31 and the shaping face 36 of the press mold 34.

FIG. 5 shows a third stage of the bending step. The circular blank 1 in which the inclined portion 4 is bent as a result of the second stage described above is held on a lower mold 38, and the outer peripheral edge portion 3 of the circular blank 1 abuts against a recessed receiving face 41 of a reception mold 39 disposed in the periphery of the lower mold 38. The center portion of the circular blank 1 is pressingly held between the lower mold 38 and a press mold 42, and a shaft (for example, a punch disposed on the press mold 42 may be used as the shaft) 43 which can be reciprocated with respect to the press mold 42 and which projects downwardly from the press mold 42, thereby fitting the circular hole 2 of the circular blank 1 onto the shaft 43. According to this configuration, the bending step is conducted using the circular hole 2 which is positioned by the shaft 43, as a reference position. In the third stage of the bending step, the press mold 42 is lowered by the press machine as indicated by the arrow d5, and a lower end portion 45 of a shaping face 44 which is formed on the press mold 42 is pressed against the part of the inclined portion 4 which is bent in the second stage. At this time, the bent shape of the inclined portion 4 depends on the shapes of the lower mold 38 and the shaping face 44 of the press mold 42.

In the bending step described above, the radially outward spread of the outer peripheral edge portion 3 of the circular blank 1 is restricted in all the first to third stages by causing the outer peripheral edge portion 3 of the inclined portion 4 of the circular blank 1 to abut against the recessed receiving faces 24, 33, and 41 of the reception molds 23, 32, and 39. Consequently, the material is prevented from flowing outwardly. Therefore, the fear that the thickness of the boss 7 is reduced as a result of the bending step is small.

Figure 8:
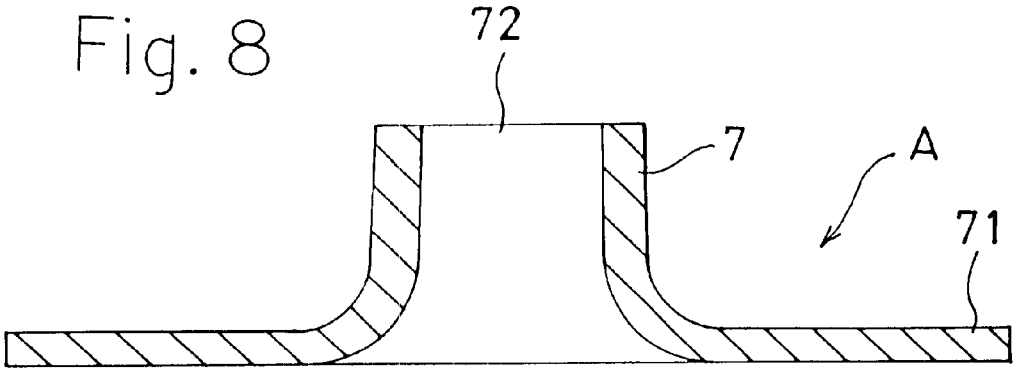
FIG. 8 is a section view of a boss-integrated sheet metal member A.

FIG. 8 shows the boss-integrated sheet metal member A having the boss 7 which is shaped by conducting the boring step (FIG. 1), the curving step (FIG. 2), and the bending step (FIGS. 3 to 5). In the boss-integrated sheet metal member A, the boss 7 projects outwardly from a lateral side (the upper side in the figure) at the center of a flat disk 71. In the boss 7, a tip end opening 72 corresponds to the circular hole 2 which is opened in the circular blank 1 in the boring step described with reference to FIG. 1. However, the diameter of the tip end opening 72 of the boss 7 is slightly larger than that of the circular hole 2 which is opened in the boring step.

In the embodiment described with reference to FIGS. 1 to 5, the curving step is conducted after the boring step. Alternatively, the curving step may be first conducted and the boring step may be then conducted.

Figure 6:
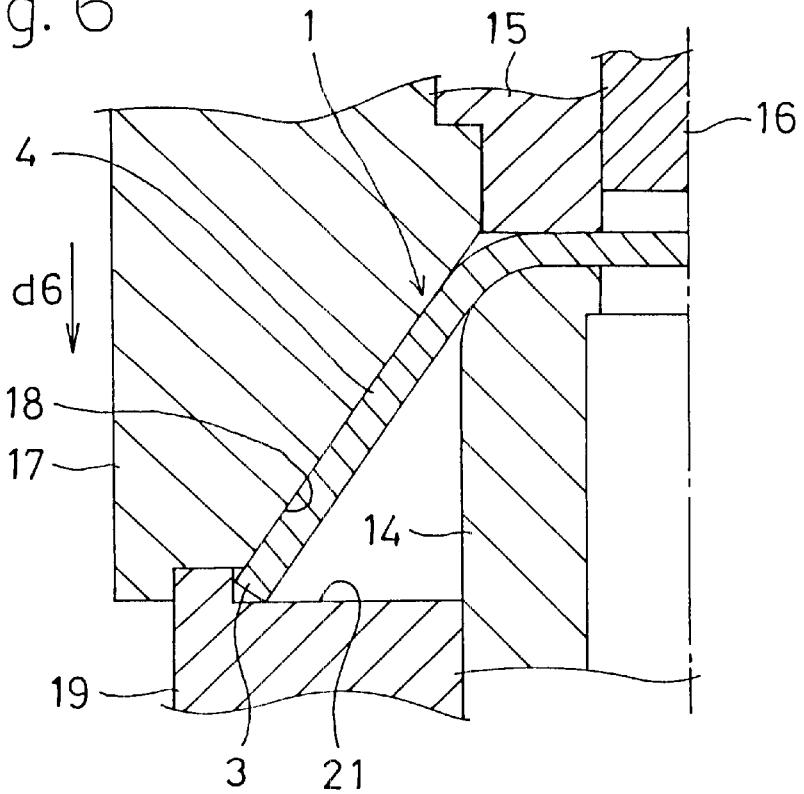
FIG. 6 is a partial section view of an apparatus showing an embodiment in which the boring step is conducted after the curving step.

FIG. 6 is a partial section view showing an embodiment in which the curving step is first conducted and the bending step is then conducted in the same molds. As the molds for conducting the curving and boring steps shown in FIG. 6, the same molds as those described with reference to FIG. 2 are used. In the curving step, the center portion of the circular blank 1 in which no hole is opened is pressingly held between the lower mold 14 and the press mold 15, and, while at least the outer peripheral edge portion 3 of the circular blank 1 remains to be supported by the recessed receiving face 21 of the reception mold 19 disposed in the periphery of the lower mold 14, the impress mold 17 disposed in the periphery of the press mold 15 is lowered by the press machine as indicated by the arrow d6, the circular blank 1 is pressed downwardly by a tapered press face 18 which downward flares, and the reception mold 19 is lowered together with the outer peripheral edge portion of the circular blank 1, thereby bending a predetermined part of the periphery of the circular hole 2 of the circular blank 1. The shape of the circular blank 1 which is formed by conducting the curving step depends on the shapes of the lower mold 14 and the press face 18 of the impress mold 17.

After the curving step is conducted in this way, the boring step is conducted. In the boring step, the shaft (the punch disposed on the press mold 15) 16 which can be reciprocated with respect to the press mold 15 is projected downwardly from the press mold 15, thereby punching out the circular hole 2 at the center of the circular blank 1.

Figure 7:
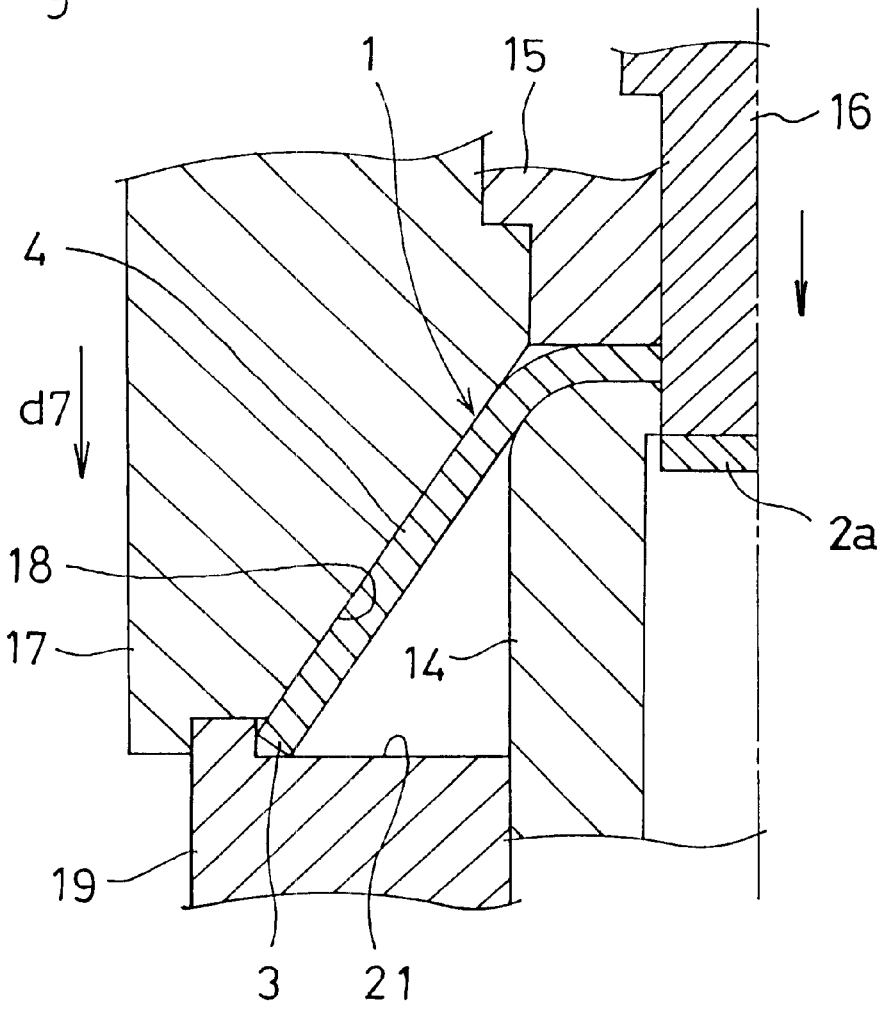
FIG. 7 is a partial section view of an apparatus showing an embodiment in which the curving step and the boring step are simultaneously conducted.

The curving and boring steps may be simultaneously conducted in the same molds. FIG. 7 is a partial section view showing an embodiment in which the curving step and the boring step are simultaneously conducted. As the molds for conducting the curving and boring steps shown in FIG. 7, the same molds as those described with reference to FIGS. 2 and 6 are used. When the curving and boring steps are to be simultaneously conducted, the center portion of the circular blank 1 in which no hole is opened is pressingly held between the lower mold 14 and the press mold 15, and, while at least the outer peripheral edge portion 3 of the circular blank 1 remains to be supported by the recessed receiving face 21 of the reception mold 19 disposed in the periphery of the lower mold 14, the press mold 17 disposed in the periphery of the press mold 15 is lowered by the press machine as indicated by the arrow d7, the circular blank 1 is pressed downwardly by the tapered press face 18 which flares downwardly, and the reception mold 19 is lowered together with the outer peripheral edge portion of the circular blank 1, thereby bending a predetermined part of the periphery of the circular hole 2 of the circular blank 1. In parallel with this, the shaft (the punch disposed on the press mold 15) 16 which can be 25 reciprocated with respect to the press mold 15 is projected downwardly from the press mold 15, thereby punching out the circular hole 2 at the center of the circular blank 1.

Alternatively, the curving step may be conducted in the same molds after the boring step is conducted. This will be described with reference to FIG. 6. While the flat circular blank 1 remains to be supported by the recessed receiving face 21 of the reception mold 19 disposed in the periphery of the lower mold 14, the impress mold 17, the press mold 15, and the shaft (the punch disposed on the press mold 15) 16 are lowered, and the circular blank 1 is pressingly held by the press mold 15 and the lower mold 14 which is lowered so as to be flush with the receiving face 21, and the shaft 16 is projected downwardly from the press mold 15, thereby forming the circular hole 2 at the center of the circular blank 1 (the boring step). Thereafter, under a state where at least the outer peripheral edge portion 3 of the circular blank 1 is supported by the recessed receiving face 21 of the reception mold 19 and the shaft 16 is fitted into the circular hole 2, the lower mold 14 and the press mold 15 are raised, and the circular blank 1 in which the circular hole 2 is formed is pressed so as to elongate along the tapered press face 18 of the impress mold 17 which downwardly flares, thereby conducting the shaping (the curving step). Also in this way, the bending step can be conducted in the same molds after the curving step is conducted.

All the shafts 26, 35, and 43 shown in FIGS. 3 to 5 are examples of the projection formed on the mold for conducting the bending step. The shaft 16 of FIG. 2 is an example of the projection formed on the mold for conducting the curving step. The shaft 16 shown in FIGS. 6 and 7 is an example of the projection which serves also as a punch and which is formed on the mold for conducting the curving step.

With reference to FIGS. 3 to 5, the embodiment in which the bending step is conducted with three stages has been described. The bending step may be conducted with four or more stages. If possible, the bending step may be conducted with one stage.

According to the method of forming a boss of a boss-integrated sheet metal member of the present invention, a combination of kinds of bending processes can form a boss which, even when the inner diameter is small, has a sufficient thickness and a sufficient projection height, without causing the thickness of a circular sheet metal blank to be reduced and by using a small press machine. Furthermore, the boss can be formed highly accurately at the center position, and a subsequent process of concentrically aligning the boss and circular portions other than the boss is not necessary. According to the present invention, therefore, a boss-integrated sheet metal member for producing a rotation ring body such as a pulley for a flat belt, a V belt, or a poly-V belt, or gear can be accurately produced at a low cost.

What is claimed is:

1. A method of forming a boss-integrated sheet metal member made from a circular sheet metal blank, comprising the steps of boring a circular hole at a center portion of the circular sheet metal blank; curving the circular sheet metal blank into a shape which projects toward a projection side of the boss; and bending and pressing a part of an inclined portion of the curved circular sheet metal blank between the outer peripheral edge portion of the circular sheet metal blank and the circular hole in a direction opposite to the projection direction, while holding the center portion containing the circular hole from moving and restricting a radially outward spread of an outer peripheral edge portion of the circular sheet metal blank which has undergone said curving step, thereby bending the inclined portion into a recessed shape to form a case-like boss in which the circular hole serves as a tip end opening, wherein said boring step and said curving step are sequentially conducted in an arbitrary order, and said bending step is then conducted while the circular hole is positioned at a reference position.

2. The method of forming a boss-integrated sheet metal member according to claim 1, wherein said bending step is conducted while the circular hole has undergone said boring step and said curving step is fitted onto a projection formed on a mold for conducting said bending step, thereby positioning the circular hole at a reference position.

3. The method of forming a boss-integrated sheet metal member according to claim 2, wherein, after said boring step is conducted, said curving step is conducted while the circular hole in said boring step is fitted onto a projection formed on a mold for conducting said curving step, thereby positioning the circular hole at a reference position.

4. The method of forming a boss-integrated sheet metal member according to claim 3, wherein said bending step is conducted in plural stages.

5. The method of forming a boss-integrated sheet metal member according to claim 2, wherein said bending step is conducted in plural stages.

6. The method of forming a boss-integrated sheet metal member according to claim 1, wherein, after said boring step is conducted, said curving step is conducted while the circular hole opened in said boring step is fitted onto a projection formed on a mold for conducting said curving step, thereby positioning the circular hole at a reference position.

7. The method of forming a boss-integrated sheet metal member according to claim 6, wherein said bending step is conducted in plural stages.

8. The method of forming a boss-integrated sheet metal member according to claim 1, wherein said bending step is conducted in plural stages.

9. A method of forming a boss-integrated sheet metal member made from a circular sheet metal blank, comprising the steps of: boring a circular hole at a center portion of the circular sheet metal blank; curving the circular sheet metal blank into a shape which projects toward a projection side of the boss and includes a portion defining the circular hole; bending the curved circular sheet metal blank while restricting a radially outward spread of an outer peripheral edge portion of the circular sheet metal blank which has undergone said curving step; and pressing a part of an inclined portion between the outer peripheral edge portion and the portion defining the circular hole while holding the portion defining the circular hole from moving, thereby bending the inclined portion into a recessed shape to form a case-like boss in which the circular hole serves as a tip end opening, wherein said boring step and said curving step are conducted in the same molds.

10. The method of forming a boss-integrated sheet metal member according to claim 9, wherein said bending step is conducted while the circular hole has undergone said boring step and said curving step is fitted onto a projection formed on a mold for conducting said bending step, thereby positioning the circular hole at a reference position.

11. The method of forming a boss-integrated sheet metal member according to claim 10, wherein, after said boring step is conducted, said curving step is conducted while the circular hole in said boring step is fitted onto a projection formed on a mold for conducting said curving step, thereby positioning the circular hole at a reference position.

12. The method of forming a boss-integrated sheet metal member according to claim 11, wherein said bending step is conducted in plural stages.

13. The method of forming a boss-integrated sheet metal member according to claim 10, wherein said bending step is conducted in plural stages.

14. The method of forming a boss-integrated sheet metal member according to claim 9, wherein said bending step is conducted in plural stages.

15. A method of forming a boss-integrated sheet metal member made from a circular sheet metal blank, comprising the steps of: boring a circular hole at a center portion of the circular sheet metal blank; curving the sheet metal blank about a first curved line in a first curved plane into a shape which projects toward a projection side of the boss; and bending and pressing a part of an inclined portion between the outer peripheral edge portion of the circular sheet metal blank and the circular hole about a second curved line in a second curved plane in a direction opposite to the projection direction, while holding the center portion defining the circular hole from moving and restricting a radially outward spread of an outer peripheral edge portion of the circular sheet metal blank which has undergone said curving step, thereby bending the inclined portion into a recessed shape to form a case-like boss in which the circular hole serves as a tip end opening, wherein said boring step and said curving step are sequentially conducted in an arbitrary order, and said bending step is then conducted while the circular hole is positioned at a reference position.

16. A method of forming a boss-integrated sheet metal member from a circular sheet metal blank, the circular sheet metal blank defining a center portion and an outer edge, the method comprising the steps of:

boring a circular hole at a center portion of the circular sheet metal blank;

holding the center portion of the circular sheet metal blank and curving the circular sheet metal blank outside of the held center portion of the circular sheet metal blank;

restraining outer movement of the outer edge of the circular sheet metal blank and holding at least part of the center portion of the circular sheet metal blank while bending and pressing a part of the curved circular sheet metal blank outside of the held center portion of the circular sheet metal blank in a direction opposite to the direction produced in said curving step; and further bending and pressing the part of the curved circular sheet metal blank outside of the held center portion of the circular sheet metal blank in said opposite direction thereby forming the boss-integrated sheet meal blank with a case-like boss.

17. The method of forming a boss-integrated sheet metal member according to claim 16, wherein said bending step is conducted while the circular hole has undergone said boring step and said curving step and is fitted onto a projection formed on a mold for conducting said bending step, thereby positioning the circular hole at a reference position.

* * * * *